US009829850B2

(12) United States Patent
Wang

(10) Patent No.: US 9,829,850 B2
(45) Date of Patent: Nov. 28, 2017

(54) PAPER HUMIDIFYING DEVICE AND IMAGE FORMING SYSTEM

(71) Applicant: Konica Minolta, Inc., Tokyo (JP)

(72) Inventor: Shuanglong Wang, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/171,739

(22) Filed: Jun. 2, 2016

(65) Prior Publication Data

US 2016/0357143 A1 Dec. 8, 2016

(30) Foreign Application Priority Data

Jun. 2, 2015 (JP) ..... 2015-111889

(51) Int. Cl.
*G03G 15/00* (2006.01)

(52) U.S. Cl.
CPC . *G03G 15/6573* (2013.01); *G03G 2215/0067* (2013.01); *G03G 2215/00662* (2013.01)

(58) Field of Classification Search
CPC ..... G03G 21/203; G03G 15/6573
USPC ..... 399/341
See application file for complete search history.

(56) References Cited

U.S. PATENT DOCUMENTS

2001/0026713 A1* 10/2001 Nishikawa ..... G03G 15/11 399/249
2009/0229515 A1* 9/2009 Kougami ..... G03G 15/6573 118/695
2015/0205258 A1* 7/2015 Sugaya ..... G03G 15/6576 399/341

FOREIGN PATENT DOCUMENTS

JP 2011-090243 A 5/2011

* cited by examiner

*Primary Examiner* — Quana M Grainger
(74) *Attorney, Agent, or Firm* — Osha Liang LP

(57) ABSTRACT

A paper humidifying device includes: a pair of humidifying rollers configured to apply moisture to paper when the paper is sandwiched and conveyed; a water feed roller configured to supply moisture to an outer peripheral surface of the pair of humidifying rollers; a dewatering unit configured to wipe off moisture on the outer peripheral surface of the pair of humidifying rollers; a first drive unit configured to cause the water feed roller to be separated from or abut on the pair of humidifying rollers; a second drive unit configured to cause the dewatering unit to be separated from or abut on the pair of humidifying rollers; and a control unit configured to control the first drive unit and the second drive unit.

9 Claims, 10 Drawing Sheets

FIG. 5

T1

| BASIS WEIGHT | DISTANCE L FROM HUMIDIFYING ROLLER FOR LOCATING BLADE AT INTRODUCTION POSITION | TIMING t FOR MOVING BLADE FROM INTRODUCTION POSITION TO RETREAT POSITION |
|---|---|---|
| EQUAL TO OR LESS THAN 60 $g/m^2$ | $L=L_1$ | $t=t_1$ |
| GREATER THAN 60 $g/m^2$ | $L=L_2(L_1<L_2)$ | $t=t_2(t_2<t_1)$ |

Prior Art

PAPER HUMIDIFYING DEVICE AND IMAGE FORMING SYSTEM

The entire disclosure of Japanese Patent Application No. 2015-111889 filed on Jun. 2, 2015 including description, claims, drawings, and abstract are incorporated herein by reference in its entirety.

BACKGROUND OF THE INVENTION

Field of the Invention

The present invention relates to a paper humidifying device and an image forming system.

Description of the Related Art

In a case where image formation includes a process of heating paper such as a fixation process performed in an electrophotographic image forming device, moisture evaporates from the heated paper to cause uneven distribution of water content in the paper, whereby curving such as waving might be generated on the paper.

In this regard, a paper processing device including a humidifying unit that applies moisture to paper on which an image has been formed is known (for example, JP 2011-90243 A). Specifically, the paper processing device corrects curving of the paper by causing the paper to which moisture has been applied by the humidifying unit to pass through a projecting and recessed part formed in a waving shape.

FIG. 10 is a view illustrating an exemplary configuration of the humidifying unit in the paper processing device.

The humidifying unit 500 includes, for example, a pair of humidifying rollers 501, 501, water feed rollers 502, 502, and reserving parts 503, 503 or the like. The water feed rollers 502, 502 each deliver water to the corresponding one of the pair of humidifying rollers 501, 501. The reserving parts 503, 503 reserve water to be supplied to the water feed rollers 502, 502. The paper P is sandwiched and conveyed by the pair of humidifying rollers 501, 501 with moisture retained on outer peripheral surfaces of the pair of humidifying rollers 501, 501, whereby moisture can be applied to the paper P.

In the above-mentioned humidifying unit 500, however, when the paper P is sandwiched and conveyed by the pair of humidifying rollers 501, 501, adhesion between the paper P and the pair of humidifying rollers 501, 501 is increased. Consequently, the paper P might be wound around the pair of humidifying rollers 501, 501 as represented by a broken line in FIG. 10, thereby hindering stable conveyance.

SUMMARY OF THE INVENTION

A paper humidifying device and an image forming system can stably convey paper to which moisture has been applied.

According to an aspect, a paper humidifying device reflecting one or more embodiments of the present invention comprises: a pair of humidifying rollers configured to apply moisture to paper when the paper is sandwiched and conveyed; a water feed roller configured to supply moisture to an outer peripheral surface of the pair of humidifying rollers; a dewatering unit configured to wipe off moisture on the outer peripheral surface of the pair of humidifying rollers; a first drive unit configured to cause the water feed roller to be separated from or abut on the pair of humidifying rollers; a second drive unit configured to cause the dewatering unit to be separated from or abut on the pair of humidifying rollers; and a control unit configured to control the first drive unit and the second drive unit, wherein the control unit is configured to: control, before a front end of the paper passes through a nip part of the pair of humidifying rollers, the first drive unit to cause the water feed roller to be separated from the pair of humidifying rollers, and control the second drive unit to cause the dewatering unit to abut on the pair of humidifying rollers to wipe off moisture on the pair of humidifying rollers; control, after the front end of the paper passes through the nip part, the first drive unit to cause the water feed roller to abut on the pair of humidifying rollers to apply moisture to the paper; and cause, during a period after the dewatering unit is caused to abut on the pair of humidifying rollers and before the water feed roller is caused to abut on the pair of humidifying rollers, the dewatering unit to be separated from the pair of humidifying rollers.

According to an aspect, an image forming system reflecting one or more embodiments of the present invention comprises: an image forming unit configured to form an image on paper; and the paper humidifying device according to the above aspect configured to humidify the paper on which the image has been formed by the image forming unit.

BRIEF DESCRIPTION OF THE DRAWINGS

The above and other advantages and features of one or more embodiments of the present invention will become more fully understood from the detailed description given hereinbelow and the appended drawings which are given by way of illustration only, and thus are not intended as a definition of the limits of one or more embodiments of the present invention, and wherein:

FIG. 5 is an exemplary setting table that sets a paper condition which is referred to in a humidifying process;

and

Figure 10:
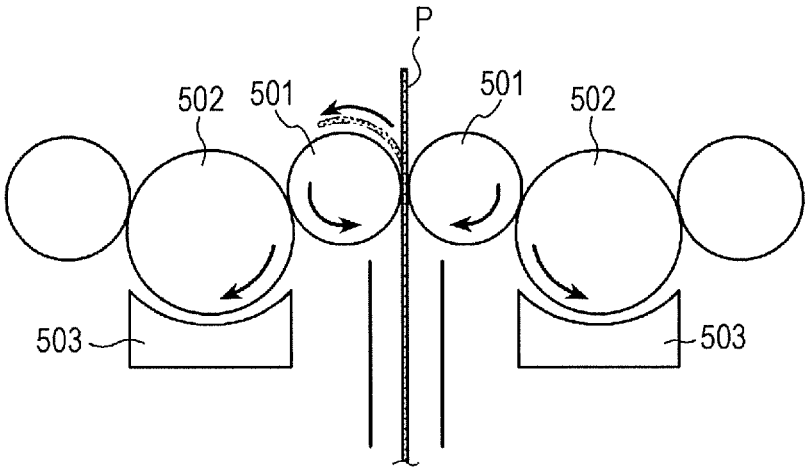

FIG. 10 is a view for explaining characteristics of conventional technology.

DESCRIPTION OF THE PREFERRED EMBODIMENTS

Hereinafter, embodiments of the present invention will be described with reference to the drawings. However, the scope of the invention is not limited to the illustrated examples.

[Image Forming System]

Figure 1:
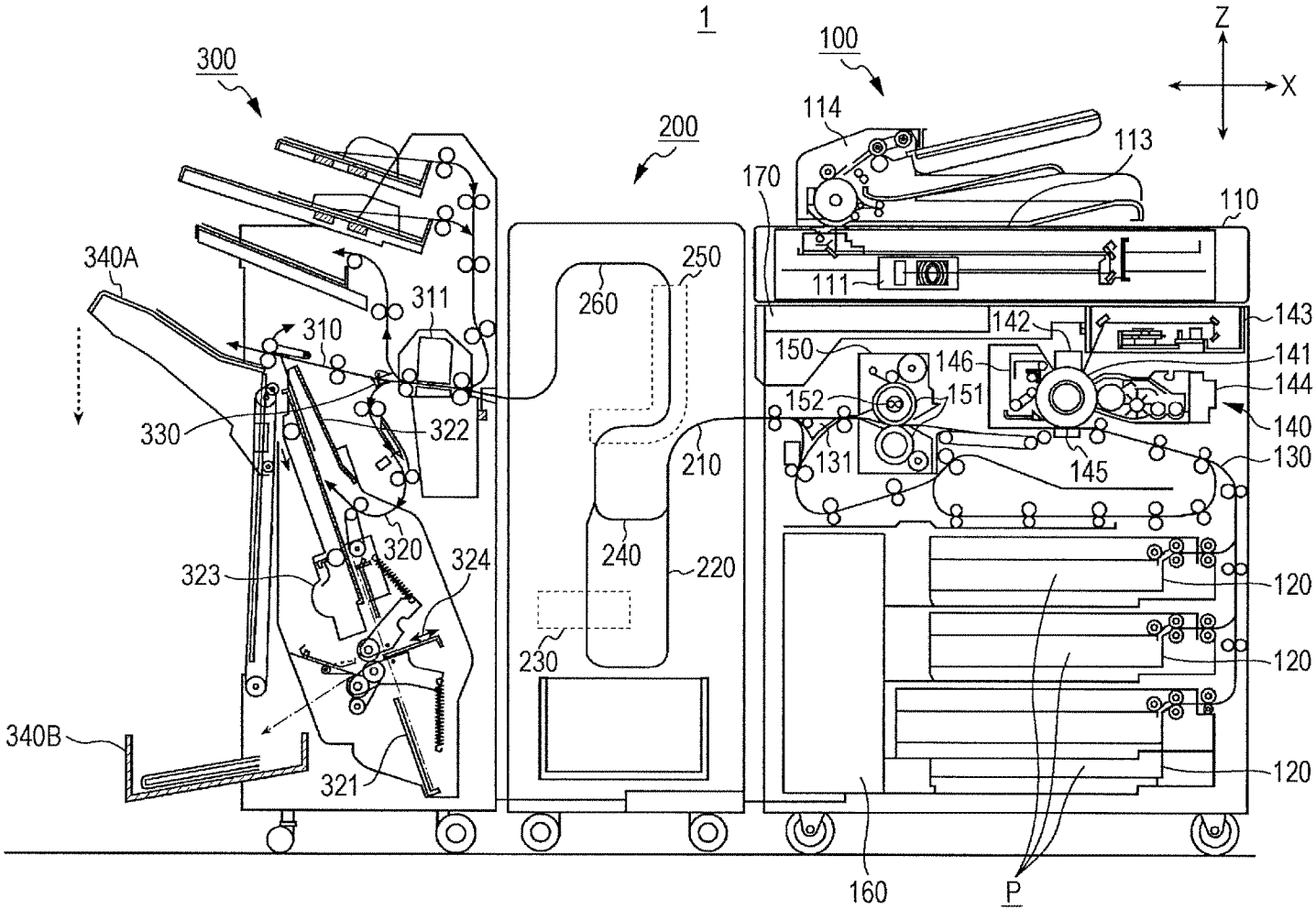
FIG. 1 is a brief schematic view illustrating an overall configuration of an image forming system.
Figure 2:
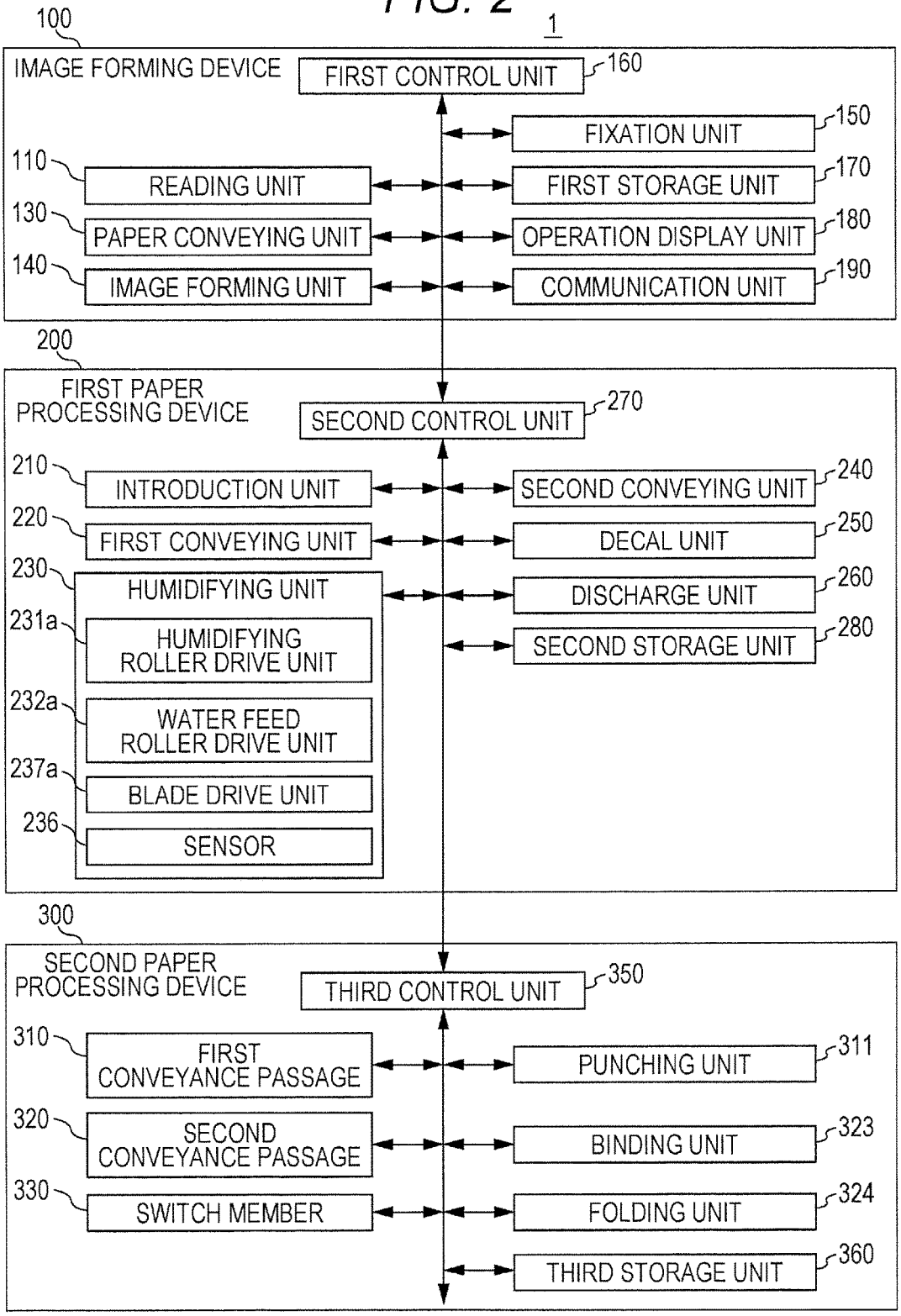
FIG. 2 is a block diagram illustrating major components related to operation control for the image forming system.

FIG. 1 is a brief schematic view illustrating an overall configuration of an image forming system 1 according to an embodiment. FIG. 2 is a block diagram illustrating major components related to operation control for the image forming system 1.

As illustrated in FIGS. 1 and 2, the image forming system 1 includes an image forming device 100, a first paper processing device 200, and a second paper processing device 300.

The image forming device 100 is a device that forms an image on paper P.

The first paper processing device 200 is a paper humidifying device that performs a humidifying process to humidify the paper P on which the image has been formed by the image forming device 100.

The second paper processing device 300 is a device that performs a punching process, a binding process, and a folding process for the paper P on which the image has been formed by the image forming device 100.

In the following description, a direction in which the image forming device 100, the first paper processing device 200, and the second paper processing device 300 are connected is assumed to be an X direction, a vertical direction is assumed to be a Z direction, and a direction orthogonal to the X direction and the Z direction is assumed to be a Y direction.

[Image Forming Device]

First, the image forming device 100 will be described.

As illustrated in FIGS. 1 and 2, the image forming device 100 includes, for example, a reading unit 110, a paper feed tray 120, a paper conveying unit 130, an image forming unit 140, a fixation unit 150, a first control unit 160, a first storage unit 170, an operation display unit (operation unit) 180, and a communication unit 190 or the like.

The reading unit 110 optically reads a document to generate image data.

Specifically, the reading unit 110 includes, for example, a sensor unit 111, a generation unit (not illustrated), a document table 113, and an auto document feeder (ADF) 114 or the like. The sensor unit 111 is equipped with an image sensor such as a charge-coupled device (CCD) image sensor and a complementary metal oxide semiconductor (CMOS) image sensor and outputs an electrical signal that depends on a read image. The generation unit generates image data based on the electrical signal output from the sensor unit 111. The document table 113 is equipped with a plate-like member having a light transmission property provided in a document reading direction of the sensor unit 111. The document table 113 is provided such that a document can be placed on the plate-like member. The auto document feeder 114 conveys a document so as to move the document relatively with respect to the sensor unit 111. The sensor unit 111 reads a document placed on the document table 113. The sensor unit 111 also reads a document conveyed by the auto document feeder 114.

The paper feed tray 120 is a box-like member provided so as to be switchable between a housed state and a drawn state with respect to a housing of the image forming device 100, and provided so as to be capable of stocking the paper P. The paper feed tray 120 stocks the paper P before an image is formed by the image forming device 100. As illustrated in FIG. 1, a plurality of the paper feed trays 120 is provided such that sheets of the paper P of different sizes can be stocked. Alternatively, sheets of the paper P of the same size may be stocked in the plurality of paper feed trays 120.

The paper conveying unit 130 conveys the paper P between the respective components such as the paper feed tray 120, the image forming unit 140, and the fixation unit 150.

Specifically, the paper conveying unit 130 has, for example, a plurality of rollers and a drive unit (not illustrated) or the like. The plurality of rollers is provided intermittently along a predetermined paper conveyance path defined between the respective components such as the paper feed tray 120, the image forming unit 140, and the fixation unit 150, and at the periphery of these components. The drive unit drives each roller. The paper conveying unit 130 extracts the sheets of the paper P stocked in the paper feed tray 120 one by one, and conveys the paper P to the image forming unit 140. The paper conveying unit 130 then conveys, to the fixation unit 150, the paper P on which an image has been formed by the image forming unit 140. The paper conveying unit 130 further conveys the paper P on which the image has been fixed by the fixation unit 150 such that the paper P is discharged from a paper discharge outlet provided at a position near the first paper processing device 200. In a case where duplex printing is performed, the paper conveying unit 130 operates to return the paper P to the image forming unit 140 from a branch point 131 provided on the conveyance path between the fixation unit 150 and the paper discharge outlet while turning the paper P upside down.

The image forming unit 140 forms an image on the paper P.

Specifically, the image forming unit 140 includes, for example, a photoreceptor 141, an electrification unit 142, an exposure unit 143, an image development unit 144, a transfer unit 145, and a cleaning unit 146 or the like. The photoreceptor 141 is provided such that an outer peripheral surface thereof abuts on the paper P conveyed by the paper conveying unit 130. The electrification unit 142 performs an electrification process for the photoreceptor 141. The exposure unit 143 performs, for the electrified photoreceptor 141, an exposure process that depends on image data. The image development unit 144 forms a toner image that depends on the image data, and transfers the toner image to the photoreceptor 141 (primary transfer). The transfer unit 145 transfers the toner image transferred to the photoreceptor 141 to the paper P (secondary transfer). The cleaning unit 146 removes, from the photoreceptor 141, toner that has remained on the photoreceptor 141. The image forming unit 140 according to an embodiment is configured as described above to perform electrophotographic image formation. However, this is only an example and the image forming unit 140 is not limited to this example. The image forming unit 140 may be equipped with a configuration for performing image formation by means of other image forming methods such as, for example, an inkjet.

The image forming unit 140 illustrated in FIG. 1 includes a single image development unit 144 and is configured to perform monochrome image formation. However, this is only an example and the image forming unit 140 is not limited to this example. For example, the image forming unit 140 may include an image development unit 144 corresponding to each color such as cyan (C), magenta (M), yellow (Y), and black (K), and may be configured to be capable of performing color printing by combining these colors.

The fixation unit 150 fixes an image formed on the paper P by the image forming unit 140.

Specifically, the fixation unit 150 includes, for example, a pair of fixation rollers 151, 151 and a heating unit 152 or the like. The pair of fixation rollers 151, 151 is provided such that outer peripheral surfaces of the fixation rollers 151, 151 abut on each other via the conveyance path for the paper P. The heating unit 152 heats, among the pair of fixation rollers 151, 151, a roller at a surface of the paper P (for example, upper surface in FIG. 1) on which an image has been formed by the image forming unit 140. The fixation unit 150 fixes, on the paper P, a toner image transferred to the paper P in such a manner that the paper P is sandwiched between the pair of fixation rollers 151, 151 driven rotationally and the paper P on which an image has been formed is conveyed while being heated by the one roller heated by the heating unit 152.

The first control unit 160 integrally controls, in accordance with a command input by the operation display unit 180 or the communication unit 190, the respective devices of the image forming system 1 and the respective components included in the devices. The first control unit 160 includes a central processing unit (CPU) and a random access memory (RAM) or the like. The CPU reads a program stored in the first storage unit 170, deploys the program on a work area in the RAM, and executes various processes in cooperation with the program.

For example, the first control unit 160 performs the image formation or the like for the paper P by means of the image forming device 100 based on image data obtained through the reading unit 110.

The first storage unit 170 stores the program to be executed by the first control unit 160 and data required for the execution of the program.

The operation display unit 180 includes a touch panel and a plurality of switches or the like. The touch panel displays various types of information related to the operation of the image forming system 1, and detects various input operations performed by a user in accordance with the displayed content. The plurality of switches is provided for the various input operations performed by the user.

The operation display unit 180 is utilized when, for example, a paper condition or the like related to operation of a humidifying unit 230 of the first paper processing device 200 is input.

Various settings related to respective processes of the image forming device 100, the first paper processing device 200, and the second paper processing device 300 input by the user via the operation display unit 180 are stored in storage units of the respective devices (the first storage unit 170, a second storage unit 280, and a third storage unit 360).

The communication unit 190 is equipped with a network interface card (NIC), or equipped with a configuration or the like corresponding to the NIC. The communication unit 190 performs communication between the image forming system 1 and another computer. When a print job including image data is input via the communication unit 190, the first control unit 160 performs image formation or the like based on the print job.

The paper P discharged from the above-mentioned image forming device 100 is conveyed to the first paper processing device 200.

[First Paper Processing Device]

Next, the first paper processing device 200 will be described.

Figure 3:
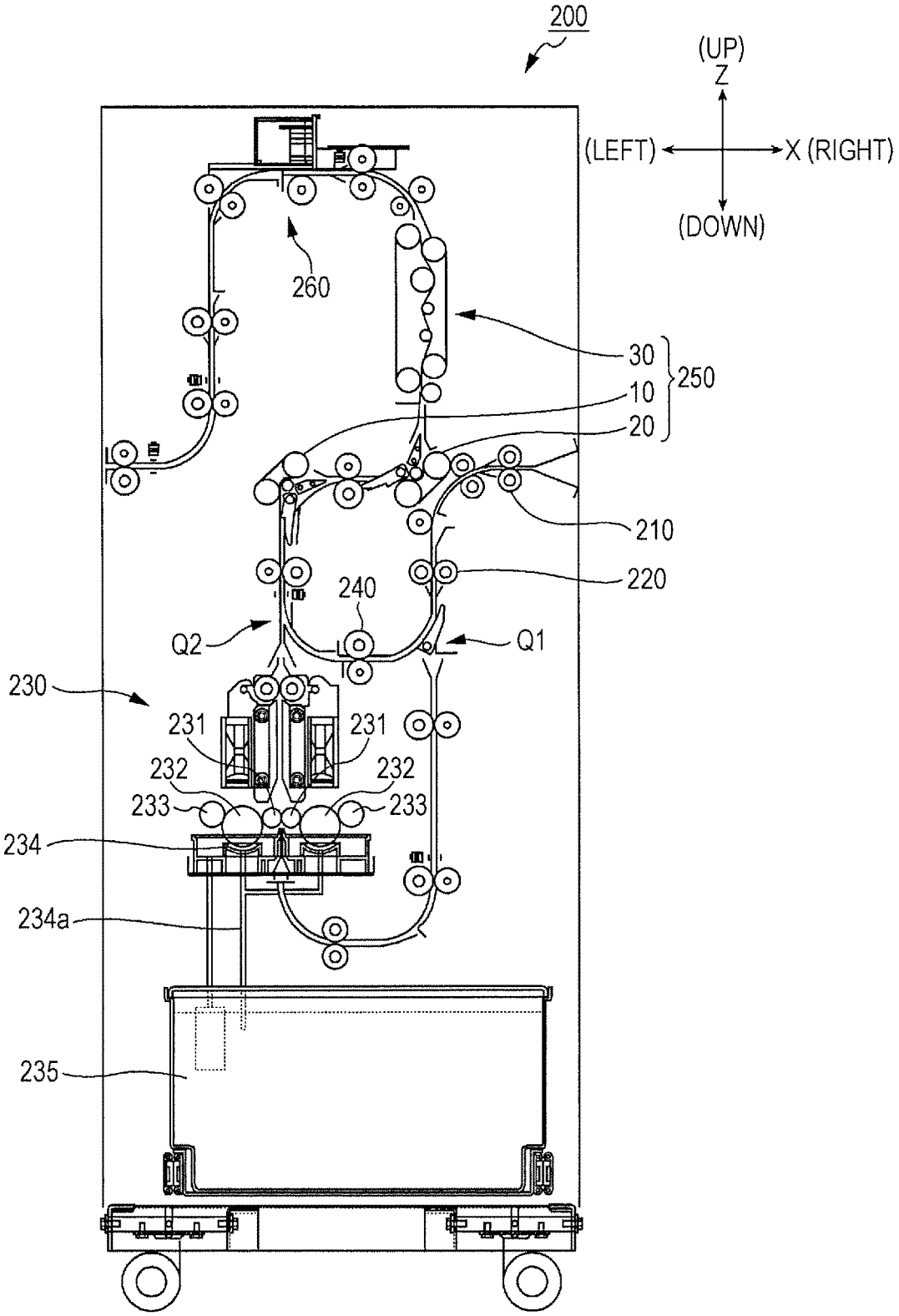
FIG. 3 is a view illustrating major components of a first paper processing device.

FIG. 3 is a view illustrating major components of the first paper processing device 200.

As illustrated in FIGS. 2 and 3, the first paper processing device 200 includes, for example, an introduction unit 210, a first conveying unit 220, the humidifying unit 230, a second conveying unit 240, a decal unit 250, a discharge unit 260, a second control unit 270, and the second storage unit 280 or the like.

In the following description, the X direction is represented by using words including "right" and "left", and the Z direction is represented by using words including "up (above)" and "down (below, low)". The "right" is a side where the image forming device 100 is located with respect to the first paper processing device 200. The "left" is a side where the second paper processing device 300 is located with respect to the first paper processing device 200. The "up (above)" is a side where the discharge unit 260 is located in the first paper processing device 200. The "down (below, low)" is a side where the humidifying unit 230 is located in the first paper processing device 200.

The introduction unit 210 accepts the paper P discharged from the image forming device 100 into the first paper processing device 200.

The first conveying unit 220 conveys, to the humidifying unit 230 provided below the introduction unit 210, the paper P accepted by the introduction unit 210 into the first paper processing device 200. A branch point Q1 is provided in the middle of the first conveying unit 220, and serves as a branch point on a conveyance path for introducing the paper P to the second conveying unit 240.

Figure 4:
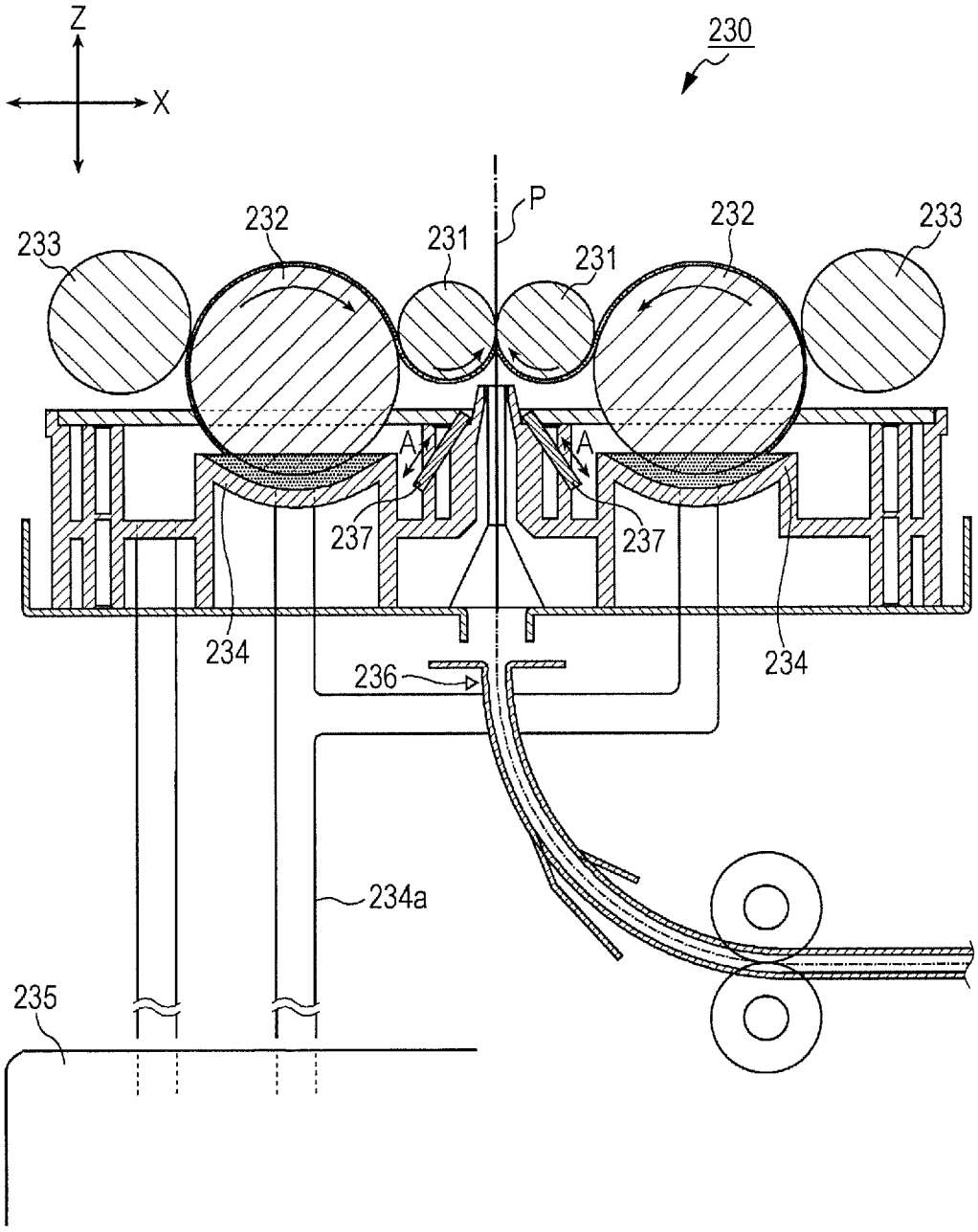
FIG. 4 is an enlarged view of main parts illustrating a configuration of a humidifying unit.

FIG. 4 is an enlarged view of main parts illustrating a configuration of the humidifying unit 230.

The humidifying unit 230 is provided for humidifying the paper P conveyed by the first conveying unit 220. The humidifying unit 230 includes, for example, a pair of humidifying rollers 231, 231, water feed rollers 232, 232, dewatering rollers 233, 233, reserving parts 234, 234, a tank 235, a sensor 236, and blades 237, 237 or the like. The water feed rollers 232, 232 each deliver water to the corresponding one of the pair of humidifying rollers 231, 231. The dewatering rollers 233, 233 wipe off excess water attached to the water feed rollers 232, 232. The reserving parts 234, 234 reserve water to be supplied to the water feed rollers 232, 232. The tank 235 stocks water. The sensor 236 is provided on an upstream side of the pair of humidifying rollers 231, 231. The blades 237, 237 wipe off excess water attached to the pair of humidifying rollers 231, 231.

The pair of humidifying rollers 231, 231 is elongated in a width direction of the paper P and provided in such a manner that outer peripheral surfaces abut on each other. The pair of humidifying rollers 231, 231 is driven by a humidifying roller drive unit 231*a* (refer to FIG. 2) to rotate, whereby the paper is sandwiched and conveyed. A rotation speed of the pair of humidifying rollers 231, 231 (conveyance speed for the paper) is controlled so as to be constant. A distance between the pair of humidifying rollers 231, 231 (pressure applied when the paper is sandwiched) is controlled so as to be constant.

The pair of humidifying rollers 231, 231 is configured such that moisture can be retained on the outer peripheral surfaces thereof. Specifically, the pair of humidifying rollers 231, 231 is formed of rubber or the like having a hydrophilic property and capable of retaining moisture. For example, acrylonitrile-butadiene rubber (NBR) or the like can be suitably used.

When the pair of humidifying rollers 231, 231 on which moisture is retained rotates with the paper P sandwiched therebetween, the pair of humidifying rollers 231, 231 humidifies the paper P while conveying the paper P downstream. When the pair of humidifying rollers 231, 231 on which moisture is not retained rotates with the paper P sandwiched therebetween, the pair of humidifying rollers 231, 231 functions as a general conveying roller that conveys the paper P downstream.

The water feed rollers 232, 232 are each provided for the corresponding one of the pair of humidifying rollers 231, 231. The water feed roller 232 rotates while abutting on the outer peripheral surface of the humidifying roller 231 and water reserved in the reserving part 234, whereby the water in the reserving part 234 is retained on an outer peripheral surface of the water feed roller 232 and conveyed to the humidifying roller 231.

The water feed rollers 232, 232 are driven by a water feed roller drive unit (first drive unit) 232*a* (refer to FIG. 2) to be enabled to move to positions where the water feed rollers 232, 232 abut on or are separated from the pair of humidifying rollers 231, 231 in the X direction.

The water feed roller drive unit 232*a* includes, for example, a stepping motor and a gear. Such a configuration as to, for example, engage the gear with rotation of the stepping motor can be used in the water feed roller drive unit 232*a*. In addition to this configuration, for example, it is possible to appropriately select a known technique such as movement along a rail performed by circumferential rotation or winding of a belt and movement performed by means of a change in hydraulic pressure or the like.

The dewatering rollers 233, 233 are provided for the respective water feed rollers 232, 232 at positions where the dewatering rollers 233, 233 are enabled to come into contact with outer peripheral surfaces of the water feed rollers 232, 232. When the water feed rollers 232, 232 rotate, the dewatering rollers 233, 233 rub the outer peripheral surfaces of the water feed rollers 232, 232, whereby excess moisture retained on the outer peripheral surfaces of the pair of humidifying rollers 231, 231 can be wiped off. As a result, an amount of water retained on the outer peripheral surfaces of the water feed rollers 232, 232 is adjusted, whereby appropriate moisture can be supplied from the water feed rollers 232, 232 to the pair of humidifying rollers 231, 231.

The reserving parts 234, 234 have arched bottoms conforming to arcs of the outer peripheral surfaces of the water feed rollers 232, 232. Water is reserved on the arched bottoms. The outer peripheral surface of each water feed roller 232 is located below a water surface of the water reserved in the reserving part 234, and located at a position where the outer peripheral surface does not abut on the arched bottom of the reserving part 234. Thus, each water feed roller 232 causes, as it rotates, the outer peripheral surface thereof to be coated with the water reserved in the reserving part 234. The reserving part 234 is coupled, via a delivery passage 234*a*, to the tank 235 located below the reserving part 234.

The tank 235 is a container in which water is stocked. Water in the tank 235 is delivered to the reserving part 234 through the delivery passage 234*a* by operation of a pump (not illustrated). As a result, an amount of water reserved in the reserving part 234 can be maintained at an appropriate amount.

The blades 237, 237 are a pair of plate bodies each provided below the corresponding one of the pair of humidifying rollers 231, 231 (upstream side in a paper conveyance direction) so as to face a nip part of the pair of humidifying rollers 231, 231. The blades 237, 237 each have a length equal to or longer than that of the pair of humidifying rollers 231, 231 in the Y direction.

The blades 237, 237 are installed in such a manner that upper ends are inclined in directions approaching each other so that a gap at an upper end side is narrower than a gap at a lower end side.

The blades 237, 237 are driven by a blade drive unit (second drive unit) 237*a* (refer to FIG. 2) to be enabled to move in an extending direction (direction of an arrow A in FIG. 4) on an XZ plane.

Specifically, the blades 237, 237 are driven by the blade drive unit 237*a* to be enabled to move to positions where the blades 237, 237 abut on or are separated from the pair of humidifying rollers 231, 231 in the A direction. Owing to this configuration, a distance of a gap between the blades 237, 237 is changed in accordance with a separation distance from the pair of humidifying rollers 231, 231.

In a case where the blades 237, 237 are located at positions where the blades 237, 237 abut on the pair of humidifying rollers 231, 231, that is, in a case where the upper ends of the blades 237, 237 are brought into contact with the outer peripheral surfaces of the pair of humidifying rollers 231, 231, the blades 237, 237 function as a dewatering unit that wipes off moisture retained on the outer peripheral surfaces of the pair of humidifying rollers 231, 231.

In a case where the blades 237, 237 are located at positions where the blades 237, 237 are separated from the pair of humidifying rollers 231, 231 by a predetermined distance (introduction position for the paper P), the blades 237, 237 function as guide plates that introduce the paper P to the nip part of the pair of humidifying rollers 231, 231.

The blade drive unit (second drive unit) 237*a* includes, for example, a rack and a pinion. Such a configuration as to, for example, engage the rack with rotation of the pinion by a motor can be used in the blade drive unit 237*a*. In addition to this configuration, for example, it is possible to appropriately select a known technique such as movement along a rail performed by circumferential rotation or winding of a belt and movement performed by means of a change in hydraulic pressure or the like.

The sensor 236 is provided at a predetermined position on the upstream side of the nip part of the pair of humidifying rollers 231, 231 in the conveyance direction of the paper P. The sensor 236 detects that the paper P has been conveyed to the predetermined position, and outputs a detection signal to the second control unit 270.

An embodiment has such a configuration that a humidifying process that depends on a paper condition is executed in the above-mentioned humidifying unit 230 under the control of the second control unit 270. The humidifying process will be described in detail later.

Returning to FIG. 3, the second conveying unit 240 conveys, to a downstream side of the humidifying unit 230, the paper P accepted by the introduction unit 210 into the first paper processing device 200 such that the paper P does not pass through the humidifying unit 230. Specifically, the second conveying unit 240 conveys, to a junction point Q2 provided on the downstream side of the humidifying unit 230, the paper P conveyed to a branch path without advancing to the humidifying unit 230 through the branch point Q1 on the first conveying unit 220.

The decal unit 250 is a mechanism for correcting curl of the paper P while conveying the paper P. The decal unit 250 includes a first decal unit 10, a second decal unit 20, and a third decal unit 30.

The first decal unit 10 and the second decal unit 20 are provided for correcting large curl of the paper P. The first decal unit 10 conveys, to the right, the paper P conveyed from below. The second decal unit 20 conveys upward the paper P conveyed from the left.

The third decal unit 30 is provided for correcting minute curl of the paper P. The third decal unit 30 applies sandwiching force to the paper P alternately from the left and the right while conveying the paper P upward from below.

The discharge unit 260 has a curved conveying unit that receives the paper P conveyed from the third decal unit 30 of the decal unit 250, conveys the paper P downward from above, and further conveys the paper P to the left. The discharge unit 260 conveys the paper P to the second paper processing device 300 through the curved conveying unit.

As mentioned above, in the first paper processing device 200, a curved conveyance path is formed within the device from the introduction unit 210 to the discharge unit 260. This configuration is employed to prevent a curving direction from deflecting to one direction for the purpose of preventing the paper P from curling to one surface side.

The second control unit 270 integrally controls the respective components included in the first paper processing device 200. The second control unit 270 includes a CPU and a RAM or the like. The CPU reads a program stored in the second storage unit 280, deploys the program on a work area in the RAM, and executes various processes in cooperation with the program.

For example, the second control unit 270 performs the humidifying process for the paper P in accordance with a preset paper condition.

The second storage unit 280 stores the program to be executed by the second control unit 270 and data required for the execution of the program.

For example, the second storage unit 280 stores a paper condition for controlling the operation of the humidifying unit 230 of the first paper processing device 200. When the paper condition for controlling the operation of the humidifying unit 230 is set by the user operation for the operation display unit 180, the set paper condition is stored in the second storage unit 280.

FIG. 5 is an exemplary setting table T1 that sets the paper condition and is stored in the second storage unit 280.

In FIG. 5, a distance (L) is set in accordance with a basis weight of the paper P used as the paper condition (in this example, a basis weight of 60 g/m$^2$ or less (thin paper) and a basis weight greater than 60 g/m$^2$ (plain paper, thick paper)). The distance (L) is a distance from the pair of humidifying rollers 231, 231 to the blades 237, 237 for locating the blades 237, 237 at the introduction position to cause the blades 237, 237 to function as the guide plates (i.e. distance of the gap between the blades 237, 237). In addition, a timing (t) for causing the blades 237, 237 functioning as the guide plates to be further separated from the pair of humidifying rollers 231, 231 to locate the blades 237, 237 at a retreat position is set.

As illustrated in FIG. 5, when the basis weight is equal to or less than 60 g/m$^2$, the distance (L) from the pair of humidifying rollers 231, 231 for locating the blades 237, 237 at the introduction position is short (distance of the gap between the blades 237, 237 is narrow), and the timing (t) for moving the blades 237, 237 from the introduction position to the retreat position is delayed, as compared with a case where the basis weight is greater than 60 g/m$^2$.

The setting in FIG. 5 is only an example, and the setting is changed appropriately. When the user operates the operation display unit 180 to set and change operation timings for the water feed rollers 232, 232 and the blades 237, 237, the above-mentioned setting is changed.

The paper condition may be a type or a thickness of the paper P in addition to the basis weight of the paper P, and may be a combination thereof.

Hereinafter, the humidifying process performed in the humidifying unit 230 of the first paper processing device 200 will be described.

Figure 6:
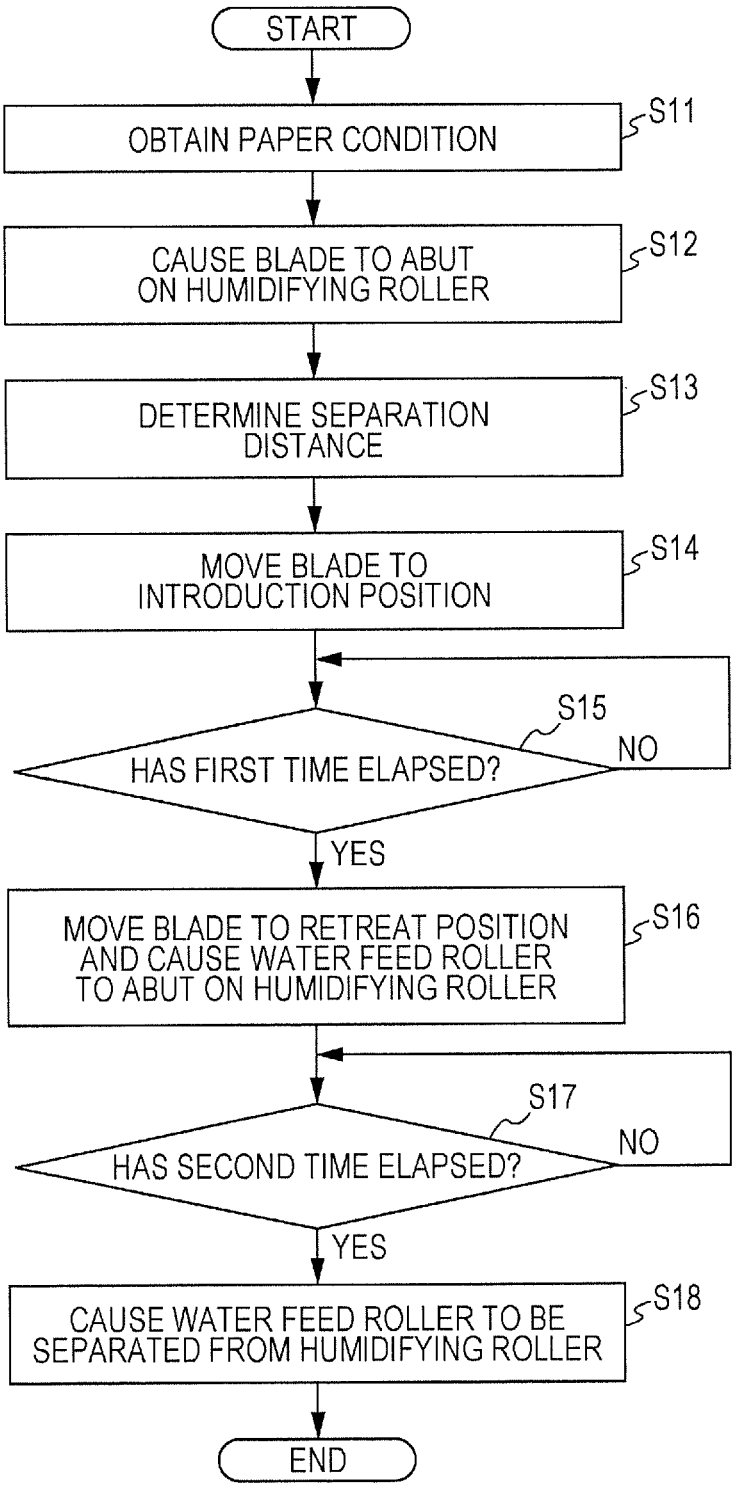
FIG. 6 is a flowchart illustrating operation of the humidifying unit in the humidifying process.

FIG. 6 is a flowchart illustrating operation for the humidifying process in the humidifying unit 230.

FIGS. 7, 8A, 8B, 9A, and 9B are schematic views each illustrating a state of the humidifying unit 230 during the humidifying process.

As a premise for the process, the pair of humidifying rollers 231, 231 and the water feed rollers 232, 232 are separated. It is assumed that the pair of humidifying rollers 231, 231 is driven by the humidifying roller drive unit 231*a* to rotate at a predetermined constant rotation speed. It is also assumed that the paper P is conveyed upward from below at a predetermined constant conveyance speed.

First, the second control unit 270 obtains the paper condition (basis weight of the paper P) included in job information (step S11).

Figure 7:
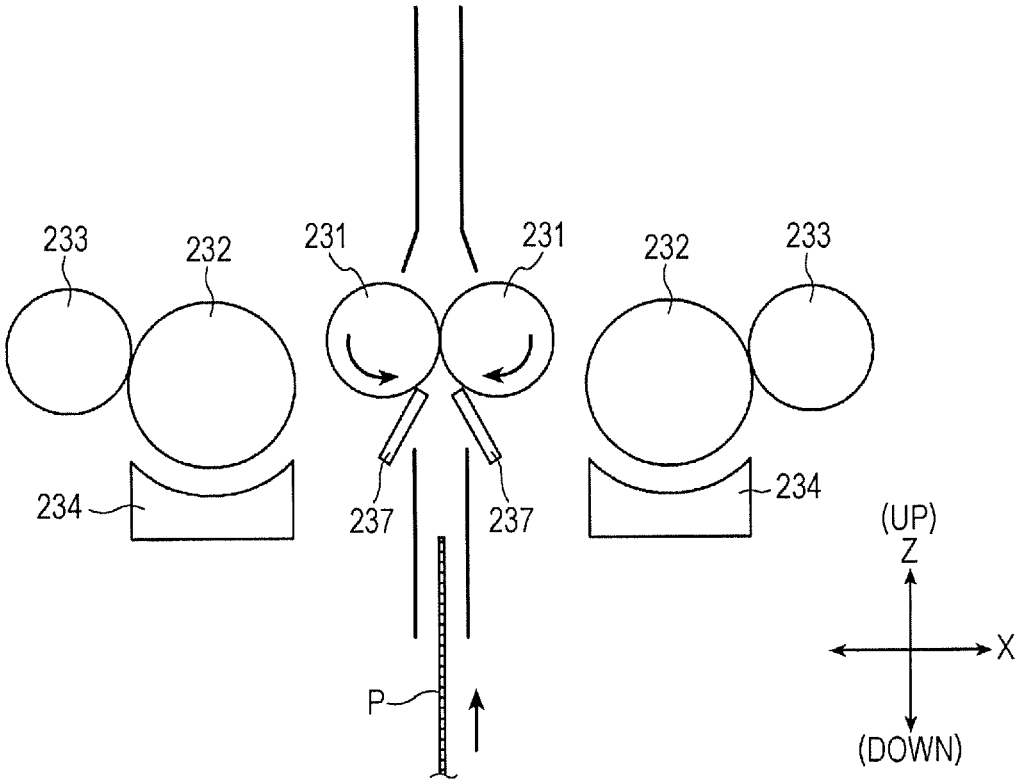
FIG. 7 is a schematic view for explaining the operation of the humidifying unit in the humidifying process.

Next, the second control unit 270 moves the blades 237, 237 upward in the A direction by means of the driving of the blade drive unit 237*a*, and causes the blades 237, 237 to abut on the pair of humidifying rollers 231, 231 (refer to FIG. 7, step S12). As a result, the upper ends of the blades 237, 237 are brought into contact with the outer peripheral surfaces of the pair of humidifying rollers 231, 231, and are enabled to wipe off and remove moisture retained on the outer peripheral surfaces of the pair of humidifying rollers 231, 231.

Next, the second control unit 270 refers to the setting table T1 stored in the second storage unit 280 to determine the distance by which the blades 237, 237 are separated from the pair of humidifying rollers 231, 231 (i.e. the distance of the gap between the upper ends of the blades 237, 237) based on the paper condition obtained in step S11 (step S13).

Figure 8A:
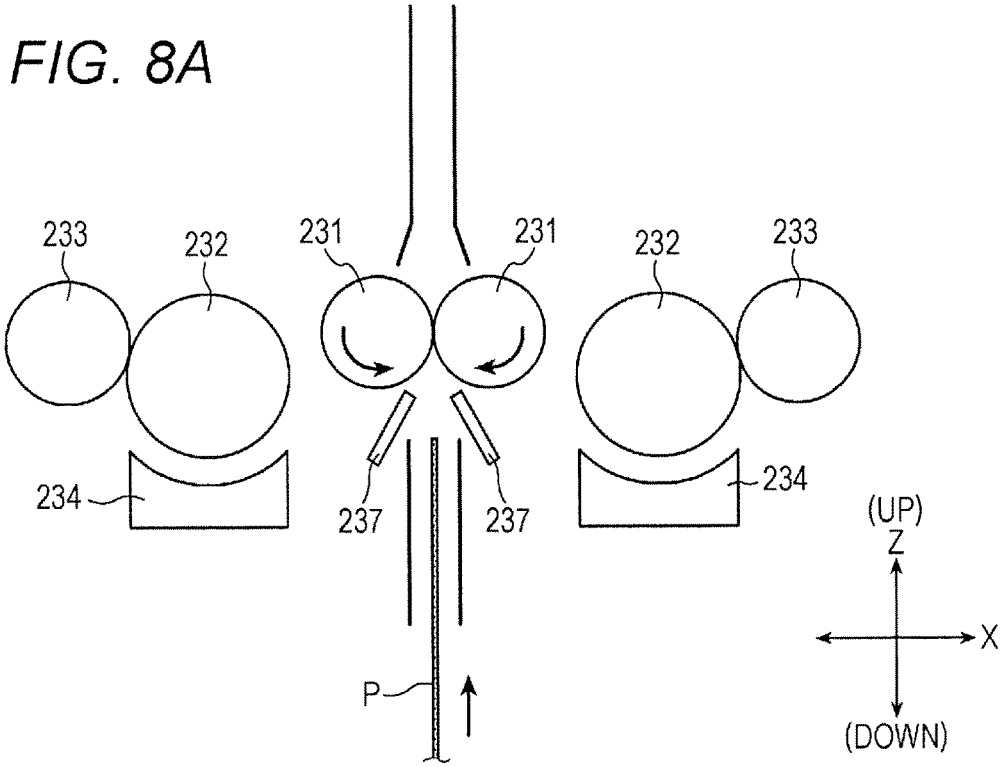
FIGS. 8A and 8B are schematic views for explaining the operation of the humidifying unit in the humidifying process.
Figure 8B:
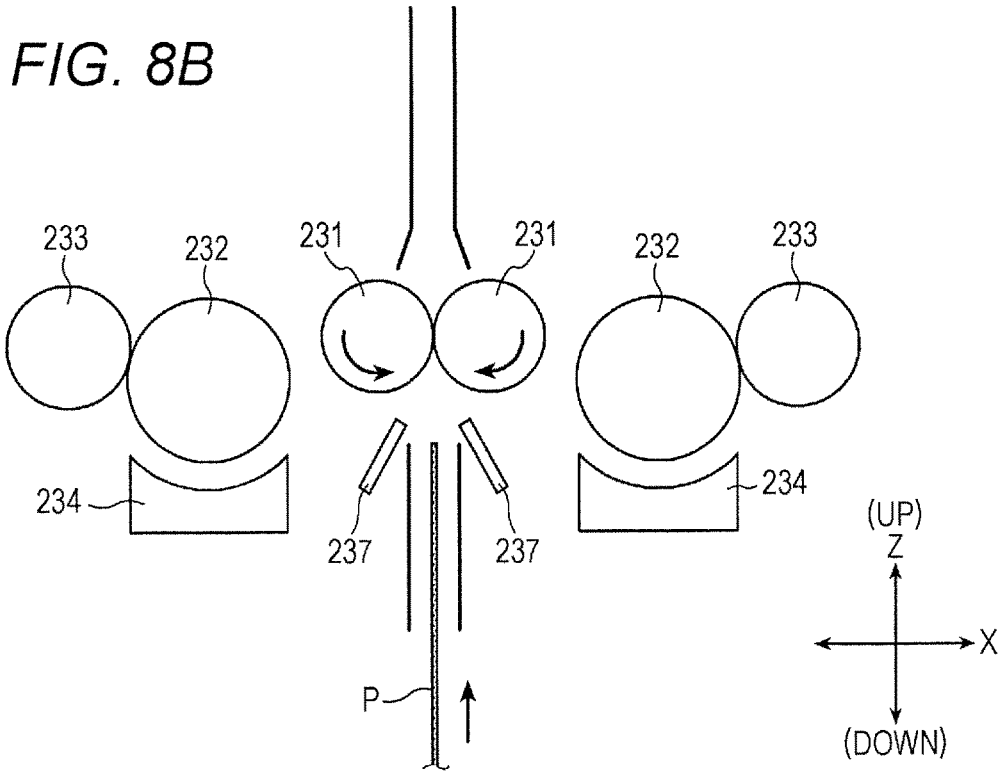
Figure 9A:
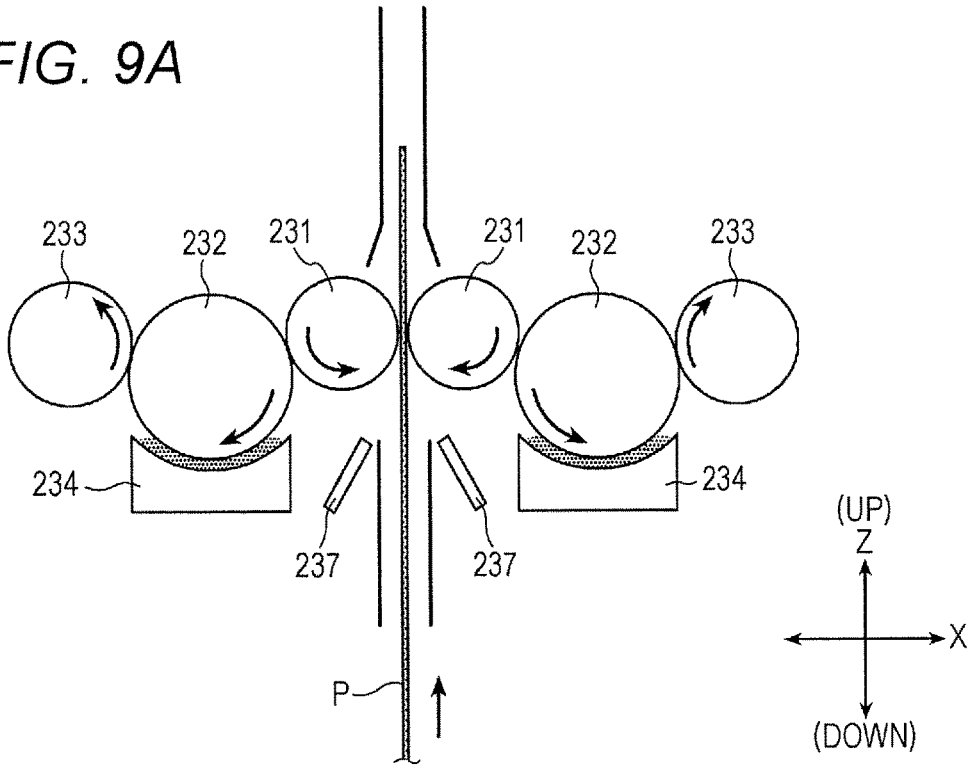
FIGS. 9A and 9B are schematic views for explaining the operation of the humidifying unit in the humidifying process.
Figure 9B:
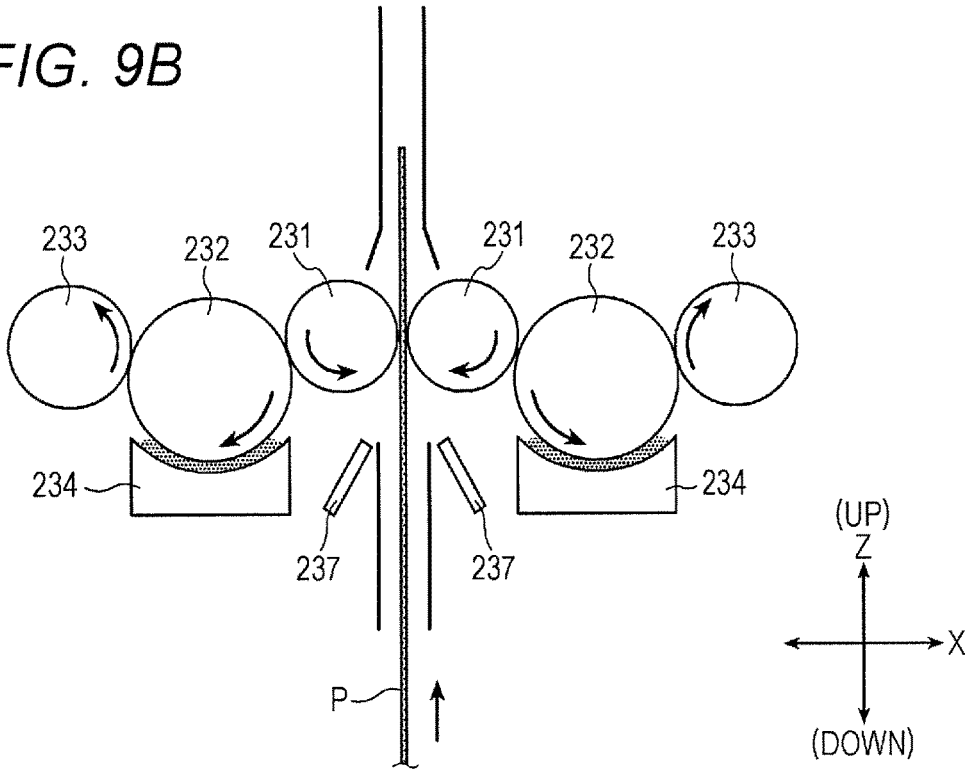

Next, the second control unit 270 moves the blades 237, 237 downward in the A direction by means of the driving of the blade drive unit 237*a*, and causes the blades 237, 237 to be separated from the pair of humidifying rollers 231, 231 by the predetermined distance (refer to FIGS. 8A and 8B, step S14).

As a result, the blades 237, 237 move to the introduction position for introducing the paper P to the nip part of the pair of humidifying rollers 231, 231 to function as the guide plates for the paper P.

At this time, the distance of the gap between the upper ends of the two blades 237, 237 becomes an appropriate distance that depends on the paper condition. For example, FIG. 8A is a case where the basis weight of the paper P is equal to or less than a predetermined value, and FIG. 83 is a case where the basis weight of the paper P is greater than the predetermined value.

As illustrated in FIGS. 8A and 8B, when the basis weight of the paper P is greater than the predetermined value, the distance by which the blades 237, 237 are separated from the pair of humidifying rollers 231, 231 is longer than that in the case where the basis weight of the paper P is equal to or less than the predetermined value. Therefore, the distance of the gap between the upper ends of the two blades 237, 237 is widened. Specifically, when the paper P is plain paper or thick paper having the basis weight of the paper P greater than the predetermined value, the distance of the gap between the upper ends of the two blades 237, 237 is widened. Therefore, these types of the paper P are hardly damaged while being guide by the blades 237, 237 and conveyed.

Next, the second control unit 270 determines whether a predetermined first time has elapsed since a front end of the paper P passed through the sensor 236 (step S15). When the first time has not elapsed (step S15: NO), the process of step S15 is repeated.

On the other hand, when the first time has elapsed (step S15: YES), the second control unit 270 moves the blades 237, 237 further downward in the A direction to the retreat position by means of the driving of the blade drive unit 237*a*, and causes the water feed rollers 232, 232 to abut on the pair of humidifying rollers 231, 231 by means of the driving of the water feed roller drive unit 232*a* (refer to FIGS. 9A and 9B, step S16).

As a result, moisture is supplied from the water feed rollers 232, 232 to the pair of humidifying rollers 231, 231, and the pair of humidifying rollers 231, 231 starts to apply moisture to the paper P.

At this time, the blades 237, 237 move to a position sufficiently separated from the pair of humidifying rollers 231, 231 (retreat position more distanced from the pair of humidifying rollers 231, 231 than the introduction position is), thereby capable of preventing moisture supplied to the pair of humidifying rollers 231, 231 from being wiped off by the blades 237, 237. Consequently, a predetermined amount of moisture is applied to the paper P by the pair of humidifying rollers 231, 231.

Next, the second control unit 270 determines, in accordance with an elapsed time (second time) since the front end of the paper P passed through the sensor 236, whether a rear end of the paper P has passed through the nip part of the pair of humidifying rollers 231, 231 (whether the second time has elapsed) (step S17). When the rear end has not passed through (step S17: NO), the process of step S17 is repeated.

On the other hand, when the rear end of the paper P has passed through the nip part of the pair of humidifying rollers 231, 231 (step S17: YES), the second control unit 270 returns the water feed rollers 232, 232 to the initial state where the water feed rollers 232, 232 are separated from the pair of humidifying rollers 231, 231 by means of the driving of the water feed roller drive unit 232*a* (step S18) to end the process.

Owing to the above-mentioned humidifying process, the paper P is conveyed to the downstream side of the humidifying unit 230, with moisture applied to a part other than the front end.

[Second Paper Processing Device]

Returning to FIG. 1, the second paper processing device 300 has, for example, a first conveyance passage 310, a second conveyance passage 320, a switch member 330, paper discharge trays 340A, 340B, a third control unit 350, and the third storage unit 360 or the like. On the first conveyance passage 310, for example, a punching unit 311 or the like is arranged. On the second conveyance passage 320, for example, a stacker 321, an alignment member 322, a binding unit 323, and a folding unit 324 or the like are arranged.

The first conveyance passage 310 is also called a straight path, and has a plurality of rollers and a drive unit (not illustrated) or the like that drives each roller to convey the paper P.

The punching unit 311 includes a punch rod and performs a punching process to form a punched hole in the paper P conveyed from the first paper processing device 200. A waste box that houses punch waste generated by the formation of the punched hole is provided below the punch rod.

The second conveyance passage 320 is also called a stack path, and has, in the same way as the first conveyance passage 310, a plurality of rollers and a drive unit (not illustrated) or the like that drives each roller to convey the paper P.

The stacker 321 stores the paper P conveyed to the second conveyance passage 320, and piles a plurality of sheets of the paper P temporarily.

The alignment member 322 is a pair of width matching members movably provided on both side surfaces of the stacker 321. The alignment member 322 can move in a direction orthogonal to the paper conveyance direction. When the paper P is conveyed on the stacker 321, the alignment member 322 is opened wider than a width of the paper. After the paper P is conveyed on the stacker 321, the alignment member 322 taps side edges in the width direction of the paper P to align the width of the paper P.

The binding unit 323 includes a stapler and performs a binding process to bind, with a staple, a paper bundle including the plurality of sheets of the paper P piled on the stacker 321. A processing condition such as the number of bound sheets, a position of binding (for example, whether a vertical side is bound or a lateral side is bound or the like), and the number of staples for binding is determined by a setting condition set in the operation display unit 180 of the image forming device 100.

The folding unit 324 performs a folding process for the plurality of sheets of the paper P piled on the stacker 321.

The paper bundle that has undergone the folding process is discharged to the paper discharge tray 340B by a conveyance belt (not illustrated).

The switch member 330 guides the conveyance direction of the paper P and causes the conveyance passage for the paper P to switch between the first conveyance passage 310 and the second conveyance passage 320. Specifically, when the switch member 330 is located at a first position, the paper P is conveyed to the first conveyance passage 310. When the switch member 330 is located at a second position, the paper P is conveyed to the second conveyance passage 320.

The paper discharge tray 340A piles the paper P discharged from the first conveyance passage 310. The paper discharge tray 3403 piles the paper P discharged from the second conveyance passage 320.

The third control unit 350 integrally controls the respective components included in the second paper processing device 300. The third control unit 350 includes a CPU and a RAM or the like. The CPU reads a program stored in the third storage unit 360, deploys the program on a work area in the RAM, and executes various processes in cooperation with the program.

For example, the third control unit 350 performs the paper process for the paper P by means of the second paper processing device 300 in accordance with a preset setting condition.

The third storage unit 360 stores the program to be executed by the third control unit 350 and data required for the execution of the program.

For example, the third storage unit 360 stores a setting condition or the like related to the paper process performed in the second paper processing device 300.

The second paper processing device 300 is not limited to the above-mentioned configuration. In addition to this configuration, the second paper processing device 300 may be equipped with, for example, a configuration for performing another paper process such as cutting.

As mentioned above, according to an embodiment, included are: a pair of humidifying rollers 231, 231 configured to apply moisture to paper P when the paper P is sandwiched and conveyed; a water feed roller 232, 232 configured to supply moisture to an outer peripheral surface of the pair of humidifying rollers 231, 231; a blade 237, 237 configured to wipe off moisture on the outer peripheral surface of the pair of humidifying rollers 231, 231; a water feed roller drive unit 232*a* configured to cause the water feed roller 232, 232 to be separated from or abut on the pair of humidifying rollers 231, 231; a blade drive unit 237*a* configured to cause the blade 237, 237 to be separated from or abut on the pair of humidifying rollers 231, 231; and a second control unit 270 configured to control the water feed roller drive unit 232*a* and the blade drive unit 237*a*, wherein the second control unit 270 is configured to: control, before a front end of the paper P passes through a nip part of the pair of humidifying rollers 231, 231, the water feed roller drive unit 232*a* to cause the water feed roller 232, 232 to be separated from the pair of humidifying rollers 231, 231, and control the blade drive unit 237*a* to cause the blade 237, 237 to abut on the pair of humidifying rollers 231, 231 to wipe off moisture on the pair of humidifying rollers 231, 231; control, after the front end of the paper P passes through the nip part, the water feed roller drive unit 232*a* to cause the water feed roller 232, 232 to abut on the pair of humidifying rollers 231, 231 to apply moisture to the paper P; and cause, during a period after the blade 237, 237 is caused to abut on the pair of humidifying rollers 231, 231 and before the water feed roller 232, 232 is caused to abut on the pair of humidifying rollers 231, 231, the blade 237, 237 to be separated from the pair of humidifying rollers 231, 231.

Therefore, since moisture is not applied to the front end of the paper P, the paper P can be prevented from being wound around the pair of humidifying rollers 231, 231.

Thus, the paper P to which moisture has been applied can be stably conveyed.

According to an embodiment, the blade 237, 237 faces the nip part on an upstream side in a paper conveyance direction of the pair of humidifying rollers 231, 231, and has a gap into which the paper P is insertable, and the second control unit 270 causes, after the blade 237, 237 is caused to abut on the pair of humidifying rollers 231, 231 and before the water feed roller 232, 232 is caused to abut on the pair of humidifying rollers 231, 231, blade 237, 237 to be separated from the pair of humidifying rollers 231, 231 and to reach an introduction position for introducing the paper P to the nip part.

Therefore, since the blade 237, 237 functions as the guide plate, the front end of the paper P can be prevented from coming into contact with the pair of humidifying rollers 231, 231 and being damaged.

According to an embodiment, the blade 237, 237 is provided such that a distance of the gap of the blade 237, 237 is changeable, and the second control unit 270 determines the distance of the gap based on a paper condition. In particular, when a basis weight as the paper condition is greater than a predetermined value, the second control unit 270 widens the distance of the gap as compared with a case where the basis weight is equal to or less than the predetermined value.

Therefore, when the blade 237, 237 is caused to function as the guide plate, the blade 237, 237 can be arranged at an appropriate position that depends on the paper P. In particular, in a case where thick paper or the like having the basis weight greater than the predetermined value is used, the gap of the blade 237, 237 is widened as compared with a case where thin paper having the basis weight equal to or less than the predetermined value is used. Therefore, the paper P can be prevented from being damaged.

According to an embodiment, when the water feed roller 232, 232 is caused to abut on the pair of humidifying rollers 231, 231, the second control unit 270 controls the blade drive unit 237*a* to cause the blade 237, 237 to be separated and to reach a retreat position more distanced from the pair of humidifying rollers 231, 231 than the introduction position is.

Therefore, when moisture is applied to the paper P, moisture retained on the pair of humidifying rollers 231, 231 is never wiped off by the blade 237, 237, and appropriate moisture can be applied to the paper P.

According to an embodiment, the second control unit 270 determines a timing for moving the blade 237, 237 to the retreat position based on a paper condition. In particular, when a basis weight as the paper condition is equal to or less than a predetermined value, the second control unit 270 delays the timing for moving the blade 237, 237 to the retreat position as compared with a case where the basis weight is greater than the predetermined value.

Therefore, when the basis weight of the paper P is equal to or less than the predetermined value (paper P is thin paper), the conveyance of the paper P is guided by the blade 237, 237 for a longer period of time, whereby the paper P that lacks firmness can be stably conveyed. On the other hand, the paper P having the basis weight greater than the predetermined value is guided by the blade 237, 237 for only a short period of time, whereby a surface of the paper P can be prevented from being damaged.

According to an embodiment, included is an operation display unit 180 configured to allow a user to set and operate operation timings for the water feed roller 232, 232 and the blade 237, 237.

Therefore, the operation timings for the water feed roller 232, 232 and the blade 237, 237 can be set and changed arbitrarily by the user.

The above-mentioned embodiment has described such an exemplary configuration that the separation distance from the pair of humidifying rollers 231, 231 is selected and set from among the two patterns in accordance with the type of the paper P when the blade 237, 237 is caused to function as the guide plate. However, such a configuration may be adopted that more detailed separation distances are set in accordance with the type of the paper P.

In terms of simplicity of control, such a configuration can also be adopted that the same separation distance is set for all the types of the paper P.

The above-mentioned embodiment has described the exemplary blade 237, 237 installed below the pair of humidifying rollers 231, 231 as the dewatering unit. However, a shape and an installation position of the dewatering unit are not limited to those of this example as long as the dewatering unit can wipe off moisture from the pair of humidifying rollers 231, 231.

Since a phenomenon in which the paper P is wound around the pair of humidifying rollers 231, 231 tends to occur when the paper P is thin paper, such control can be adopted, in accordance with the type of the paper P, that the above-mentioned humidifying process which does not apply water to the front end of the paper P is not executed when, for example, the paper P is thick paper. Specifically, when the paper P is thick paper, water is only required to be applied first to the front end of the paper P. In this configuration, the blade 237, 237 does not need to be controlled when the paper P is thick paper, whereby the control can be simplified.

An embodiment has described such an exemplary configuration that each of the image forming device 100, the first paper processing device 200, and the second paper processing device 300 includes the control unit for performing the control in the device and the communication between the devices. However, such a configuration may also be adopted that only a single control unit that integrally controls the entire image forming system 1 is included.

An embodiment has described such an exemplary configuration that each of the image forming device 100, the first paper processing device 200, and the second paper processing device 300 includes the storage unit that stores the setting or the like of the device. However, such a configuration may also be adopted that only a single storage unit that stores a setting of the entire image forming system 1 is included.

Although embodiments of the present invention have been described and illustrated in detail, it is clearly understood that the same is by way of illustrated and example only and is not to be taken by way of limitation, the scope of the present invention being interpreted by terms of the appended claims.

What is claimed is:

1. A paper humidifying device comprising:

a pair of humidifying rollers that apply moisture to paper when the paper is sandwiched and conveyed;

a water feed roller that supplies moisture to an outer peripheral surface of the pair of humidifying rollers;

a dewatering unit that wipes off moisture on the outer peripheral surface of the pair of humidifying rollers;

a first drive unit that causes the water feed roller to be separated from or abut on the pair of humidifying rollers;

a second drive unit that causes the dewatering unit to be separated from or abut on the pair of humidifying rollers; and a control unit that controls the first drive unit and the second drive unit, wherein the control unit:

controls, before a front end of the paper passes through a nip part of the pair of humidifying rollers, the first drive unit to cause the water feed roller to be separated from the pair of humidifying rollers, and controls the second drive unit to cause the dewatering unit to abut on the pair of humidifying rollers to wipe off moisture on the pair of humidifying rollers;

controls, after the front end of the paper passes through the nip part, the first drive unit to cause the water feed roller to abut on the pair of humidifying rollers to apply moisture to the paper; and causes, during a period after the dewatering unit is caused to abut on the pair of humidifying rollers and before the water feed roller is caused to abut on the pair of humidifying rollers, the dewatering unit to be separated from the pair of humidifying rollers.

2. The paper humidifying device according to claim 1, wherein the dewatering unit faces the nip part on an upstream side in a paper conveyance direction of the pair of humidifying rollers, and includes a pair of plate bodies having a gap into which the paper is insertable, and the control unit causes, after the pair of plate bodies of the dewatering unit is caused to abut on the pair of humidifying rollers and before the water feed roller is caused to abut on the pair of humidifying rollers, the pair of plate bodies to be separated from the pair of humidifying rollers and to reach an introduction position for introducing the paper to the nip part.

3. The paper humidifying device according to claim 2, wherein the pair of plate bodies is provided such that a distance of the gap is changeable, and the control unit determines the distance of the gap based on a paper condition.

4. The paper humidifying device according to claim 3, wherein when a basis weight as the paper condition is greater than a predetermined value, the control unit widens the distance of the gap as compared with a case where the basis weight is equal to or less than the predetermined value.

5. The paper humidifying device according to claim 2, wherein when the water feed roller is caused to abut on the pair of humidifying rollers, the control unit controls the second drive unit to cause the dewatering unit to be separated and to reach a retreat position more distanced from the pair of humidifying rollers than the introduction position is.

6. The paper humidifying device according to claim 5, wherein the control unit determines a timing for moving the dewatering unit to the retreat position based on a paper condition.

7. The paper humidifying device according to claim 6, wherein when a basis weight as the paper condition is equal to or less than a predetermined value, the control unit delays the timing for moving the dewatering unit to the retreat position as compared with a case where the basis weight is greater than the predetermined value.

8. The paper humidifying device according to claim 1, comprising an operation unit that sets operation timings for the water feed roller and the dewatering unit.

9. An image forming system comprising:

an image forming unit that forms an image on paper; and the paper humidifying device according to claim 1 that humidifies the paper on which the image has been formed by the image forming unit.

* * * * *